United States Patent [19]

Meeker et al.

[11] Patent Number: 4,470,511

[45] Date of Patent: Sep. 11, 1984

[54] QUICK OPENING ENVELOPE

[75] Inventors: David M. Meeker, Saratoga; Harold R. Lillibridge, Burlingame, both of Calif.

[73] Assignee: Champion International Corporation, Stamford, Conn.

[21] Appl. No.: 559,860

[22] Filed: Dec. 12, 1983

Related U.S. Application Data

[63] Continuation of Ser. No. 353,176, Mar. 1, 1982, abandoned.

[51] Int. Cl.[3] ..... B65D 27/34; B65D 27/36

[52] U.S. Cl. ..... 206/610; 206/628

[58] Field of Search ..... 206/610, 620, 628, 632

[56] References Cited

U.S. PATENT DOCUMENTS

| | | | |
|---|---|---|---|
| 1,306,224 | 6/1919 | Godley | 206/628 |
| 1,336,646 | 4/1920 | Mendenhall | 206/628 |
| 2,112,816 | 3/1938 | Rulon | 206/628 |
| 3,652,008 | 3/1972 | Grotefend | 206/610 |

FOREIGN PATENT DOCUMENTS

| | | | |
|---|---|---|---|
| 112505 | 12/1968 | Denmark | 206/626 |

*Primary Examiner*—Stephen P. Garbe

*Attorney, Agent, or Firm*—Evelyn M. Sommer; William W. Jones

[57] ABSTRACT

A quick opening envelope which gives full access to its interior upon opening is disclosed. The envelope is formed from a blank constructed from a single sheet of flexible material having a plurality of fold lines defining a front panel, a back panel, two side flaps and a closure flap. The back panel is provided with a V-shaped array of die cut perforations, each of which includes an arc portion and a tangent portion. The V-shaped array of perforations enables neat and easy opening of the envelope.

1 Claim, 4 Drawing Figures

QUICK OPENING ENVELOPE

This application is a continuation of application Ser. No. 353,176, filed Mar. 1, 1982, now abandoned.

BACKGROUND OF THE INVENTION

This invention relates to envelopes. More particularly, it relates to quick opening envelopes which provide for easy and full access to their interior for the safe withdrawal of their contents.

It is well known that the usual method of opening an envelope after the latter has been sealed entails the insertion of a letter opener or like instrument at one corner of the envelope to shear at least one folded edge portion thereof. Although this method proves satisfactory in most instances, it has a number of substantial drawbacks. The main drawback is that in many instances the individual opening the envelope, in addition to shearing the folded edge of the envelope, will inadvertently shear a folded edge of the document contained therein.

Moreover, once an envelope has been opened in the above manner, it is impossible to reclose it so as to assure that its contents if returned to the envelope, will not fall out. In this respect, envelopes are often opened by simply tearing the glued flap portion away from the body of the envelope. Although this saves the problem of reclosure, it often results in the tearing of the envelope, thereby leaving a ragged unsightly condition.

Other procedures used for opening envelopes include tearing the side edge portion, however, this has also proved unsatisfactory since, if the enclosed letter fills the envelope flush to the end, which in most instances is the case, the contents of the envelope may be mutilated.

In order to overcome the above-identified drawbacks, a number of quick opening envelopes have been developed. Although these envelopes have overcome many of the problems associated with prior art techniques, they are in many cases unsightly, require special handling during manufacturing, are expensive to make and therefore expensive to use, and do not provide full access to the interior of the envelope when opened.

Accordingly, it is an object of the subject invention to provide a quick opening envelope that can be opened easily and cleanly without separate tools and without the risk of damaging the contents of the envelope.

It is another object of the subject invention to provide a quick opening envelope which when opened, will give full access to the contents of the envelope.

It is a further object of the subject invention to provide a quick opening envelope that can be neatly and partially reclosed.

It is still another object of the subject invention to provide a quick opening envelope wherein the opening mechanism does not interfere with the portion of the envelope on which the name and address of the addressee appears.

Finally, it is still another object of the subject invention to provide a quick opening envelope which can be economically produced with a minimum amount of material and which can be constructed from a single integrally formed blank.

SUMMARY OF THE INVENTION

In accordance with this invention, an improved quickopening envelope has been provided. The subject quick opening envelope is constructed from a single sheet of foldable material comprising five panels or flaps. More specifically, a substantially rectangular front panel is provided for bearing the name and address of the addressee. Side flaps are hingedly attached to opposite side edges of the front panel and define the enclosed end portions of the subject envelope. A back panel is hingedly attached to the bottom edge of the front panel, and is folded over and adhesively attached to the side flaps. The back panel includes a plurality of arcuate perforations arranged in a V formation, with the apex of the V nearest the hinged connection between the front and back panels. The arcuate perforation at the apex of the V defines a pull tab which can be readily grasped by a thumb and forefinger. A closure flap is hingedly connected to the top edge of the front panel and can be adhesively secured to the back panel thereby closing the subject envelope. A force exerted on the pull tab enables a separation of the back panel along the perforations to easily and cleanly open the subject quick opening envelope.

This design provides an envelope that can be securely closed, but that can be quickly and easily opened. Additionally, the design enables the subject envelope to be partially and neatly reclosed.

Further objects and advantages of the invention will become apparent from reading the following detailed description taken in conjunction with the drawings.

DESCRITPION OF THE DRAWINGS

DESCRIPTION OF THE PREFERRED EMBODIMENT

Figure 1:
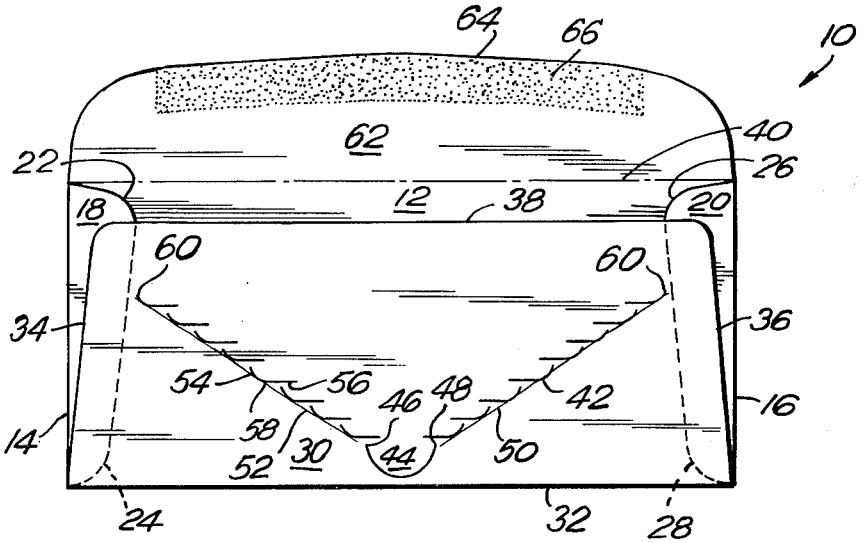
FIG. 1 is a plan view of the subject envelope viewed from the back with the closure flap in the open position.

Referring to FIG. 1, the quick opening envelope of the subject invention is indicated generally as number 10. Envelope 10 includes a substantially rectangular front panel 12 that is approximately 8 $\frac{7}{8}$ inches long and 3 $\frac{7}{8}$ inches high. Hingedly connected to opposite side ends 14 and 16 of front panel 12 are side flaps 18 and 20. Side flaps 18 and 20 lay flat against the inside surface of front panel 12. Corners 22 and 24 on side flap 18 and corners 26 and 28 on side flap 20 are rounded to facilitate the formation of the subject envelope, and to make insertion of items into the folded envelope easier.

Back panel 30 is hingedly connected to bottom edge 32 of front panel 12 and is further defined by its side edges 34 and 36 and top edge 38. The portions of back panel 30 adjacent side edges 34 and 36 thereof are in surface to surface contact with side flaps 18 and 20 respectively. The remainder of back panel 30 is in surface to surface contact with front panel 12. Back panel 30 has a trapezoidal configuration such that edges 32 and 38 are parallel. Side edges 34 and 36 of back panel 30 taper toward one another as they extend from bottom edge 32 toward top edge 38. This trapezoidal configuration of back panel 30 ensures that sides edges 34 and 36 of back panel 30 will not extend beyond side edges 14 and 16 of front panel 12 when back panel 30 is flush against front panel 12 and side flaps 18 and 20.

Back panel 30 is adhesively secured to side flaps 18 and 20.

The distance between bottom edge 32 and top edge 38 of back panel 30 is approximately three and one-fourth inches. Thus, as shown in FIG. 1, there is slightly more than one-half inch between top edge 38 of back panel 30 and top edge 40 of front panel 12. This space between top edges 38 and 40 of back panel 30 and front panel 12 respectively facilitates insertion of items into the envelope.

Centrally disposed on back panel 30 is a V-shaped formation defined by a plurality of arcuate die cut perforations 42. The vertex of the V formation is defined by a die cut semi-circular tab 44 disposed convex side downward approximately one-eighth inch above bottom edge 32 of back panel 30. The radius of tab 44 is approximately one-half inch.

The V formation is defined by two rows of eight perforations 42 extending angularly upward toward top edge 38 of back panel 30 from the topmost points 46 and 48 of tab 44. As with tab 44, each arcuate perforation 42 has its covex side disposed in a generally downward direction. The eight arcuate perforations 42 closest to side edge 36 of back panel 30 are arranged to have a common tangent, indicated by line 50, that intersects uppermost point 48 of tab 44. Similarly, the eight arcuate perforations closest to side edge 34 of back panel 30 are arranged to have a common tangent, indicated by line 52, that intersects uppermost point 46 on tab 44. The angle between bottom edge 32 of back panel 30 and either tangent 50 or 52 is approximately 33°.

Each arcuate perforation 42 comprises an arc portion 54 having a radius of approximately one-quarter inch, and a tangent portion 56 approximately one-quarter inch long. Each tangent portion 56 of arcuate perforations 42 extends parallel to bottom edge 32 of back panel 30. Furthermore, each tangent protion 56 of arcuate perforations 42 extends from the point 58 where each arc portion 54 of arcuate perforations 42 is closest to bottom edge 32 of back panel 30. More specifically, each tangent 56 extends from its respective point 58 on arcuate perforation 42 toward the central portion of back panel 30. A tangent to arc portion 54 of arcuate perforation 42 at the upper point 60 thereon would intersect bottom edge 32 of back panel 30 at an angle of approximately 72°. Approximately one-sixteenth inch separates adjacent arcuate perforations 42. Additionally, uppermost points 46 and 48 on tab 44 are also approximately one-sixteenth inch from the respective arcuate perforations 42 closest thereto. The small separation between perforations combined with the angular relationship described above virtually assures a neat severance, and precludes inadvertent ripping of back panel 30.

Ends 60 of the two arcuate perforations 42 closest to top edge 38 of back panel 30 are separated from one another by approximately seven inches. This distance is slightly less than the distance between side flaps 18 and 20 at the points thereon that are intersected by top edge 38 of back panel 30. This relationship between side flaps 18 and 20 and the two perforations 42 that are closest to edge 38 of back panel 30 substantially facilitates the opening of envelope 10, as explained below.

Closure flap 62 is hingedly connected to top edge 40 of front panel 12. Centrally disposed along edge 64 of closure flap 62 is adhesive strip 66, which is approximately six and one-half inches long and one-half inch wide. The distance between edges 40 and 64 of closure flap 62 is great enough to enable adhesive strip 66 to extend beyond edge 38 of back panel 30 when closure flap 62 is in the closed position shown in FIG. 2. Returning to FIG. 1, adhesive strip 66 typically is a glue that becomes bondable upon contact with moisture. However, in certain applications, a pressure sensitive adhesive may be used. The length and width of adhesive strip 66 is such that it will contact only back panel 30; and more specifically, only that portion of back panel 30 between ends 60 of the arcuate perforations 42 closest to edge 38 of back panel 30. As explained below, this arrangement greatly facilitates the opening of envelope 10.

Figure 3:
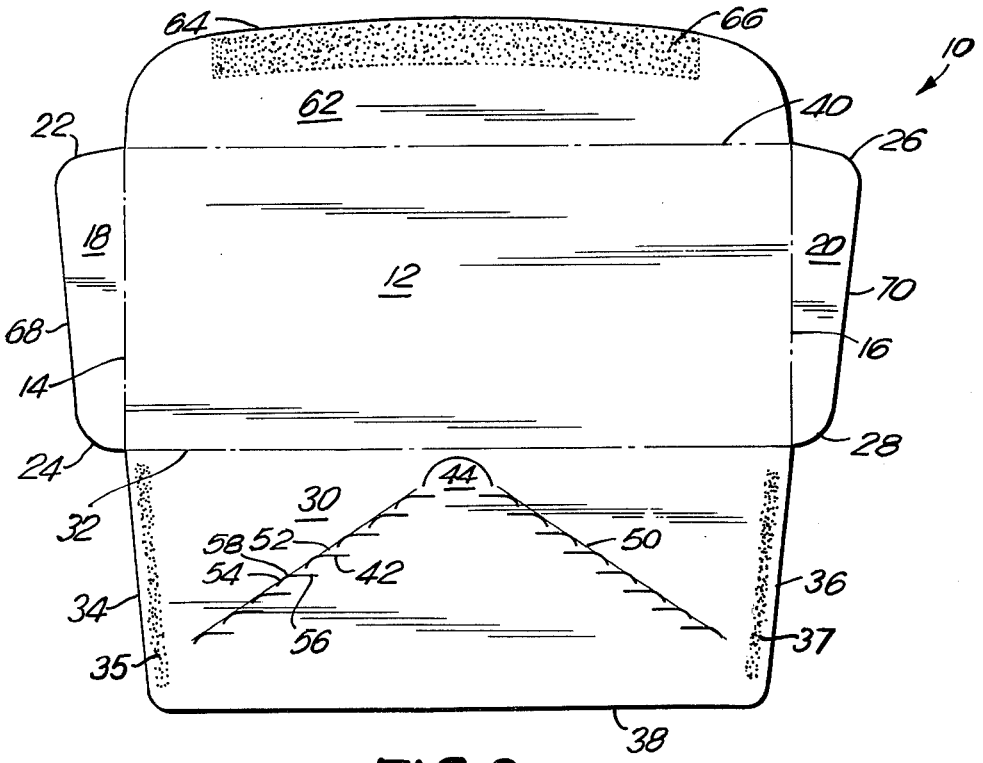
FIG. 3 is a plan view of the blank for forming the subject envelope.

The blank 10 for forming the subject envelope is shown in FIG. 3. Specifically, the surface of blank 10 shown in FIG. 3 defines the inside surfaces of the subject envelope.

Front panel 12 of blank 10 is substantially rectangular and is defined by opposed side edges 14 and 16, bottom edge 32 and top edge 40. Hingedly attached to front panel 12 at opposed side edges 14 and 16 respectively are side flaps 18 and 20. Side flap 18 is defined by rounded corners 22 and 24 which extend between edges 14 and 68. The radius of rounded corner 22 is greater than the radius of rounded corner 24. As a result, edge 68 is disposed at an angle to hinged connection 14 between side flap 18 and front panel 12. Similarly, side flap 20 is defined by rounded corners 26 and 28 which extend between fold line 16 and edge 70. Rounded corner 26 has a larger radius than rounded corner 28. As a result, edge 70 is disposed at an angle to fold line 16. This relationship between the respective edges of side flaps 18 and 20 facilitates the application of adhesive to secure back panel 30 to side flap 18, as explained below.

Back panel 30 is hingedly connected to front panel 12 along fold line 32. Back panel 30 is substantially trapezoidal with edge 38 being susbtantially parallel to, but shorter than fold line 32. Edge 34 of back panel 30 is parallel to edge 68 of side flap 18. Similarly, edge 36 of back panel 30 is parallel to edge 70 of side flap 20. By this arrangement, the edges of back panel 30 and side flaps 18 and 20 will be parallel on the folded envelope. Adhesive strips 35 and 37 are adjacent edges 34 and 36 respectively and are attached to side flaps 18 and 20 on the completed envelope.

Arcuate perforations 42 are arranged in an essentially V-shaped formation, with eight arcuate perforations 42 in each leg of the V. The apex of the V-formation is defined by semi-circular die cut perforation 44 which has its convex side facing fold line 32, and spaced approximately one-eighth inch therefrom. As explained in greater detail above, each arcuate perforation 42 includes a circular arc portion 54 and a tangent portion 56. Tangent portions 56 are parallel to one another and to fold line 32. Approximately one-sixteenth inch separates adjacent perforations, and approximately seven inches separates end points 60 on the perforations 42 closest to edge 38 of back panel 30.

Closure flap 62 is hingedly connected to front panel 12 along fold line 40. Adhesive strip 66 is adjacent to and centrally located on edge 64 of closure flap 62. As stated previously, adhesive strip 66 is approximately six and one-half inches long and one-half inch wide. This configuration ensures that one the completed envelope closure flap 64 will be adhered only to back panel 30.

The subject envelope 10 is formed from the blank described herein by first folding end flaps 18 and 20 toward each other along fold lines 14 and 16 respectively such that end flaps 18 and 20 are in surface to surface contacting relationship with front panel 12. Subsequently, back panel 30 is folded into surface to surface contacting relationship with side panels 18 and 20 and front panel 12. Adhesive strips 35 and 37 on back panel 30 are secured to side flaps 18 and 20 respectively thereby securing the blank into the form of an envelope. Closure flap 62 may be folded along fold line 40 incto face to face contacting relationship with back panel 30, front panel 12 and side flaps 18 and 20. Closure flap 62, of course, would not be adhesively secured to back panel 30 during shipping and storage prior to use. However, after insertion of the item to be mailed into envelope 10, closure flap 62 would be adhesively secured to back panel 30 by means of adhesive strip 66.

Figure 2:
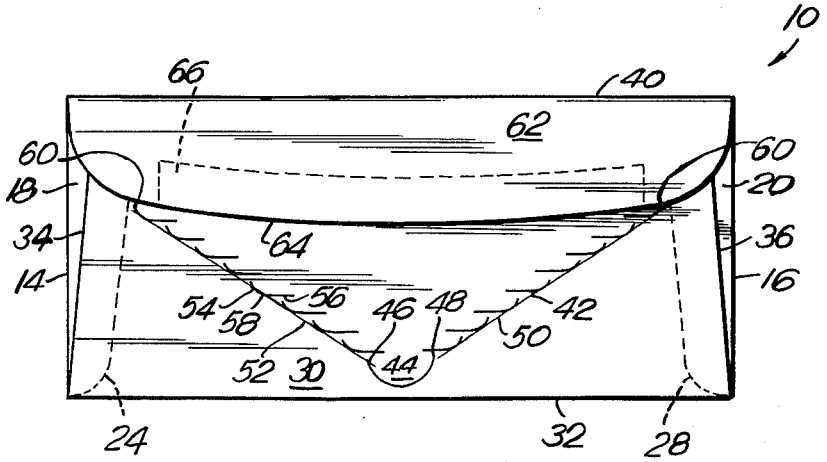
FIG. 2 is a plan view of the subject envelope viewed from the back with the closure flap in the closed position.

The quick opening features of the subject envelope would be initiated when the envelope 10 is in the closed position as shown in FIG. 2. To employ the quick opening feature, the user of the envelope grasps tab 44 with a thumb and forefinger. The semi-circular shape and relatively large size of tab 44 and the proximity of tab 44 to bottom edge 32 of envelope 10 facilitates the grasping of tab 44. To even further facilitate the initial grasping of tab 44, the user merely bends envelope 10 slightly causing the plane thereof to become discontinuous, and causing tab 44 to separate slightly from back panel 30.

Figure 4:
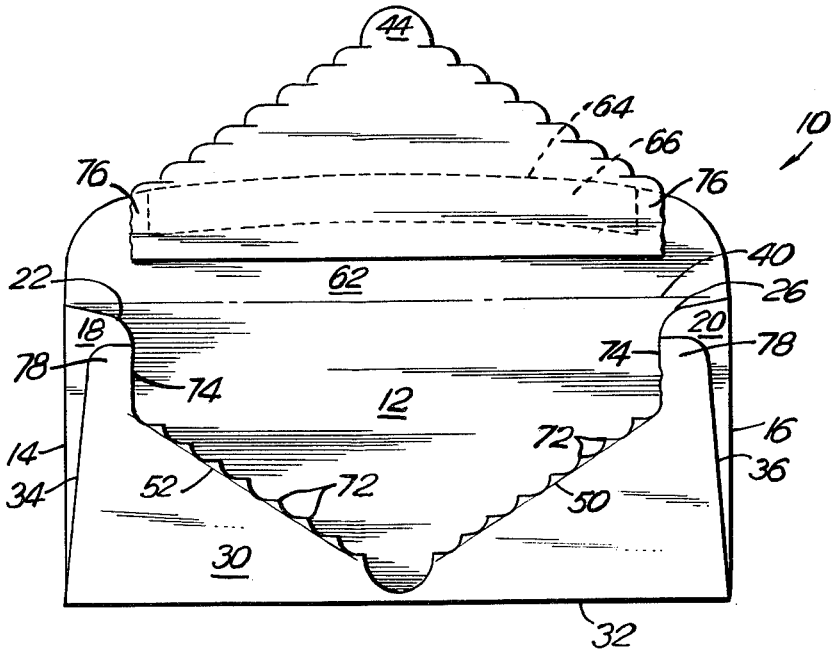
FIG. 4 is a plan view of the subject envelope viewed from the back with the back panel entirely separated along the perforations.

After initially grasping tab 44, the user of envelope 10 pulls tab 44 away from the plane defined by back panel 30, and toward top edge 40 of envelope 10. This pulling force successively tears back panel 30 of envelope 10 between adjacent arcuate perforations. As shown in FIG. 4, the severance lines 72 formed by this pulling will be substantially parallel to the direction of the force exerted on tab 44. Thus, the severance lines 72 between adjacent perforations 42 will be substantially perpendicular to top and bottom edges 32 and 40 of envelope 10. In most instances, pairs of severance lines 72 will be formed simultaneously on opposite legs of the V formation. The tangential portions 56 of arcuate perforations 42 function as temporary and varying fold lines as tab 44 is being pulled from back panel 30. Tangential portions 56 also ensure that a force exerted on tab 44 that is not precisely perpendicular to top and bottom edge 32 and 40 of envelope 10 will not unintentionally rip the portion of back panel 30 that is being lifted. This tendency of the lifted portion of back panel 30 not to tear, can be attributed to the differential twisting thereof that is enabled by tangential portions 56 of arcuate perforations 42.

As explained above, closure flap 62 is adhered only to the portion of back panel 30 between ends 20 of the arcuate perforations 42 closest to edge 38 of back panel 30. Thus, as the last perforations 42 are being severed by the lifting force on tab 44, closure flap 62 also will be lifted upwardly. The severance lines 74 between edge 38 of back panel 30 and the uppermost points 60 on arcuate perforations 42 closest to edge 38 will be approximately three-fourths of an inch long, which is substantially longer than severance lines 72. These longer severance lines 74, however, will be relatively straight and clean because the portions of back panel 30 on either side of the longer severance lines are firmly adhered to respective parts of envelope 10 that are moving relative to one another. Specifically, portions 76 of back panel 30 adjacent severance line 72 are adhered to closure flap 62, which as mentioned above, is being lifted upwardly. However, portions 78 of back panel 30 adjacent to severance lines 72 are firmly adhered to side flaps 18 and 20 which are not being lifted upwardly. By this arrangement, a neat clean opening of envelope 10 is provided, along severance lines 74 on back panel 30.

After being opened, as shown in FIG. 4, envelope 10 may be partially reclosed merely by folding closure flap 62 back towards its original position. The individual severances 72 between perforations 42 will not be precisely perpendicular to the plane of back panel 30. Rather, individual severances 72 will define an angle across the thickness of the material from which envelope 10 is made. As a result, there will be some overlapping at each severance 72. Due to this small amount of overlapping, the portion of back panel 30 that has been lifted, may be slid under the stationary portions of back panel 30 at the severances 72. This minor frictional engagement generally will be sufficient to hold envelope 10 in a partially closed condition.

Accordingly, there is provided a quick opening envelope comprising a front panel, two side flaps foldably connected to opposite side edges of the front panel, a back panel foldably connected to the bottom edge of the front panel, and a closure flap foldably connected to the top edge of the front panel. The back panel includes a plurality of arcuate die cut perforations arranged thereon in a generally V-shape. The apex of the V defines a semi-circular tab that is easily graspable. An upward force exerted on the tab will sever the back panel between adjacent perforations thereby providing quick and easy access to the contents of the envelope. More specifically, the relationship between the perforations, the side flaps and the adhesive strip on the closure flap enables the closure flap to be opened along with the severed back panel.

The subject invention, and many of its intended advantages will be understood from the foregoing description, and it will be apparent that various changes may be made in the form of the subject quick opening envelope without departing from the spirit and scope of the invention as defined by the following claims.

What is claimed is:

1. A quick opening paper envelope comprising:

(a) substantially rectangular planar front panel having opposed inner and outer surfaces, a top edge, a bottom edge, and first and second opposed side edges;

(b) first and second substantially identical side flaps hingedly connected respectively to said first and second side edges of said front panel, said first and second side flaps each having an inner and an outer surface, the inner surfaces of said first and second side flaps abutting the inner surface of said front panel;

(c) a back panel having opposed inner and outer surfaces, a bottom edge, a top edge, and first and second opposed side edges, the bottom edge of said back panel being hingedly connected to the bottom edge of said front panel, the inner surface of said back panel being adhesively attached to the outer surfaces of said first and second side flaps respectively, said back panel including a two-legged V-shaped array of arcuate die cut perforations, the vertex of said V-shaped array of arcuate die cut perforations converging toward the bottom edge of said back panel, each said arcuate die cut perforation having its convex side generally facing the bottom edge of said back panel, the vertex of said V-shaped array of arcuate die cut perforations being defined by a semi-circular perforation which defines a pull tab for opening said quick opening envelope, each of said arcuate die cut perforations extending from said pull tab comprising an arcuate portion and a tangent portion, each of said tangent portions extending parallel to the bottom edge of said back panel and away from the nearest side edge of said back panel and away from the location on its associated arc portion closest to the bottom edge of said back panel, the arcuate portion of each arcuate die cut perforation in one leg of said V-shaped array being tangent to a first imaginary straight line extending upwardly at an acute angle from said semi-circular perforation toward a first upper corner of said envelope, and the arcuate portion of each arcuate die cut perforation in the other leg fo said V-shaped array being tangent to a second imaginaty straight line extending upwardly at an acute angle from said semi-circular perforation toward a second upper corner of said envelope; and (d) a closure flap having opposed inner and outer surfaces, a top edge and at least one sealing edge, said top edge of said closure flap being hingedly connected to the top edge of said front panel, an adhesive area disposed on the inner surface of said closure flap adjacent said sealing edge, the length of said adhesive area as measured parallel to the top edge of said closure flap being less than the distance between the arcuate perforations on said back panel most distant from the pull tab thereon, the distance from said top edge of said closure flap to the adhesive area on said closure flap being such that said closure flap may be adhesively secured to the outer surface of said back panel thereby closing said envelope.

* * * * *